US005813311A

United States Patent [19]

Toyooka et al.

[11] Patent Number: 5,813,311

[45] Date of Patent: Sep. 29, 1998

[54] HYDRAULIC CONTROL SYSTEM FOR HYDRAULIC WORKING MACHINE

[75] Inventors: Tsukasa Toyooka, Ibaraki-ken; Toichi Hirata, Ushiku; Genroku Sugiyama, Ibaraki-ken; Shigehiro Yoshinaga, Yokohama; Kouji Ishikawa, Tsuchiura; Youichi Kowatari; Tsuyoshi Nakamura, both of Ibaraki-ken, all of Japan

[73] Assignee: Hitachi Construction Machinery Co., Ltd., Tokyo, Japan

[21] Appl. No.: 771,158

[22] Filed: Dec. 20, 1996

[30] Foreign Application Priority Data

Dec. 26, 1995 [JP] Japan ..... 7-339051

[51] Int. Cl.[6] ..... F15B 11/16

[52] U.S. Cl. ..... 91/513; 60/422; 91/516

[58] Field of Search ..... 60/422; 91/513, 91/516, 517

[56] References Cited

U.S. PATENT DOCUMENTS

| | | | |
|---|---|---|---|
| 3,349,670 | 10/1967 | Bahl et al. | 91/516 |
| 3,592,216 | 7/1971 | McMillen | 91/518 |
| 4,385,674 | 5/1983 | Presley | 60/422 |
| 4,768,339 | 9/1988 | Aoyagi et al. | 91/513 |
| 4,977,928 | 12/1990 | Smith et al. . | |
| 5,493,950 | 2/1996 | Kim | 91/516 |

FOREIGN PATENT DOCUMENTS

| | | |
|---|---|---|
| 326 150 | 1/1989 | European Pat. Off. . |
| 379595A1 | 7/1989 | European Pat. Off. . |
| 503073A1 | 9/1991 | European Pat. Off. . |
| 620370A1 | 10/1993 | European Pat. Off. . |
| 652376A1 | 11/1994 | European Pat. Off. . |
| 5-332320 | 12/1993 | Japan . |

*Primary Examiner*—F. Daniel Lopez
*Attorney, Agent, or Firm*—Fay, Sharpe, Beall, Fagan, Minnich & McKee

[57] ABSTRACT

A controller 520 has a data portion 520*c* in which the relationship between a pump delivery pressure and a target opening area of a variable throttle 300*a* of a control valve 300 is set such that the target opening area is large when the pump delivery pressure is low, and small when the pump delivery pressure is high. An input portion 520*a* takes in a detection signal from a pump pressure sensor 700, a processing portion 520*b* reads the data from the data portion 520*c* and calculates a signal output to a solenoid proportional valve 590, and an output portion 520*d* converts the calculated signal into a command signal for the solenoid proportional valve 590 and outputs the command signal. Upon receiving the command signal from the controller 520, the solenoid proportional valve 590 produces a command pilot pressure for the control valve 300 corresponding to the input signal and controls the opening area of the variable throttle 300*a*.

10 Claims, 9 Drawing Sheets

HYDRAULIC CONTROL SYSTEM FOR HYDRAULIC WORKING MACHINE

BACKGROUND OF THE INVENTION

1. Field of the Invention

The present invention relates to a hydraulic control system for a hydraulic working machine such as a hydraulic excavator, and more particularly to a hydraulic control system for a hydraulic working machine which can achieve satisfactory combined operation when a plurality of actuators equipped on the hydraulic working machine are operated simultaneously.

2. Description of the Related Art

One prior art hydraulic control system relating to combined operation of multiple actuators in a hydraulic working machine is described in JP-A-5-332320. The control system described therein comprises a first directional control valve for introducing a hydraulic fluid supplied from a hydraulic source to a swing motor, and a second directional control valve for introducing the hydraulic fluid to an arm cylinder. These directional control valves are of center bypass type and each has a center bypass passage for communicating a center bypass line and a reservoir with each other when the valve is in a neutral position, two first and second input ports for taking in the hydraulic fluid through a check valve disposed in a line branched from the center bypass line, a reservoir port for introducing the hydraulic fluid to the reservoir, and output ports for introducing the hydraulic fluid to the swing motor or the arm cylinder. Also, there is an input line coupling an input line connected to the first input port of the second directional control valve and an input line connected to the second input port thereof, with a control valve having a variable throttle disposed as auxiliary flow control means in the coupling input line.

The prior art control system further comprises a solenoid proportional valve for supplying a command pilot pressure to the control valve, a swing pilot pressure sensor for detecting a pilot pressure supplied to the first directional control valve to move it, a selection switch for instructing whether the arm operation or the swing operation is given priority during the combined operation, and a controller for receiving a signal from the selection switch and a detection signal from the swing pilot pressure sensor, calculating a command pilot pressure for the control valve based on those input signals, and outputting a command signal in accordance with the calculated result to the solenoid proportional valve.

The controller comprises an input portion for taking in the signal from the selection switch and the detection signal from the swing pilot pressure sensor, a data portion in which are set beforehand relationships between the detection signal (swing lever input amount) from the swing pilot pressure sensor and a target opening area of the variable throttle of the control valve, these relationships being different depending on whether the arm operation or the swing operation is given priority, a processing portion for receiving the detection signals from the input portion, reading data from the data portion and calculating a command pilot pressure for the control valve, and an output portion for receiving the calculated value from the processing portion, converting it into a command signal for the solenoid proportional valve and outputting the command signal.

Specifically, set in the data portion are data having a moderate gradient with respect to the swing lever input amount as data of the target opening area corresponding to the case where the arm operation is given priority (arm precedence), and data having a steep gradient with respect to the swing lever input amount as data of the target opening area corresponding to the case where the swing operation is given priority (swing precedence). In response to the signal from the selection switch instructing the arm precedence or the swing precedence, the controller reads the pilot pressure detected by the swing pilot pressure sensor, calculates a command pilot pressure for the control valve in accordance with the data taken out of the data portion, and outputs a command signal corresponding to the calculated value to the solenoid proportional valve.

Upon receiving the command signal from the controller, the solenoid proportional valve produces a command pilot pressure for the control valve corresponding to the input signal and controls the opening area of the variable throttle of the control valve.

In the prior art hydraulic control system constructed as described above, when swing precedence work, e.g., digging work with the front device held in a pressed state under the swing operation, is performed, the controller selects the data having a steep gradient for the swing precedence upon the operator instructing the swing precedence through the selection switch. Therefore, the opening area of the variable throttle of the control valve is throttled to a large extent in accordance with the swing lever input amount, causing the hydraulic fluid to be supplied to the swing motor at a sufficient flow rate so that driving forces necessary for the swing precedence work, i.e., swing pressing forces, can be produced.

On the other hand, when arm precedence work, e.g., smoothing work under the swing operation, is performed, the controller selects the data having a moderate gradient for the arm precedence upon the operator instructing the arm precedence through the selection switch. Therefore, the opening area of the variable throttle of the control valve is controlled to increase so that the arm cylinder can be supplied with the hydraulic fluid at a flow rate necessary for the arm precedence work.

Thus, according to the prior art, the amount of control effected by the control valve can be changed by operating the selection switch so as to change the driving forces of the swing motor or the amount of the hydraulic fluid supplied to the arm cylinder depending on the type of work.

SUMMARY OF THE INVENTION

The above-mentioned prior art, however, has had the problem that in work where load conditions of the actuators are frequently varied, unless the instruction of selecting the swing precedence or the arm precedence is changed correspondingly, each actuator cannot be given appropriate driving forces or an appropriate flow rate of the hydraulic fluid, resulting in a deterioration of the working efficiency.

For example, if smoothing work under the swing operation (arm precedence work) is performed while the swing precedence is kept instructed, the variable throttle is throttled to a large extent based on the data having a steep gradient for the swing precedence. Therefore, the flow rate of the hydraulic fluid supplied to the arm cylinder becomes deficient, the arm speed is lowered, and hence the working efficiency is deteriorated.

Also, if digging work with the front device held in a pressed state under the swing operation (swing precedence work) is performed while the arm precedence is kept instructed, the variable throttle is throttled just a little based on the data having a moderate gradient for the arm precedence. Therefore, the hydraulic fluid is supplied to the arm cylinder at an excessive flow rate and to the swing motor at a deficient flow rate. Accordingly, an upper structure cannot be operated by sufficient swing forces and the working efficiency is deteriorated.

Thus, according to the prior art, when the type of work to be performed is frequently varied, the instruction of selecting the swing precedence or the arm precedence must be changed correspondingly, which imposes a great burden on the operator.

An object of the present invention is to provide a hydraulic control system for a hydraulic working machine with which, in spite of change in load conditions of actuators, each actuator can be given appropriate driving forces or an appropriate flow rate of a hydraulic fluid with no need of priority instruction.

To achieve the above object, the present invention is constructed as follows.

(1) According to the present invention, in a hydraulic control system for a hydraulic working machine comprising a hydraulic source, a plurality of actuators driven by a hydraulic fluid supplied from the hydraulic source, a plurality of directional control valves controlling respective flows of the hydraulic fluid supplied to the plurality of actuators, the plurality of directional control valves including first and second directional control valves connected to the hydraulic source in parallel, and auxiliary flow control means disposed in an input line connected to an input port of the second directional control valve, the hydraulic control system further comprises pressure detecting means for detecting a pressure of the hydraulic fluid supplied from the hydraulic source, and control means for controlling, based on a signal from the pressure detecting means, auxiliary flow control means to reduce a flow rate of the hydraulic fluid flowing through the input line when the pressure of the hydraulic fluid supplied from the hydraulic source is high.

By so providing the pressure detecting means and the control means and controlling the auxiliary flow control means to reduce a flow rate of the hydraulic fluid flowing through the input line when the pressure of the hydraulic fluid supplied from the hydraulic source is high, the hydraulic control system operates as follows. In work where the actuator associated with the first directional control valve has a high load pressure during the combined operation performed by operating both the first and second directional control valves simultaneously, the supply pressure of the hydraulic source becomes high and the auxiliary flow control means is controlled so as to greatly reduce the flow rate of the hydraulic fluid flowing through the input line. Therefore, the actuator associated with the first directional control valve can be operated with a driving pressure necessary for that work and hence can provide appropriate driving forces. On the other hand, in work where the load pressure of the actuator associated with the first directional control valve is not so raised, the auxiliary flow control means is controlled so as to slightly reduce the flow rate of the hydraulic fluid flowing through the input line. Therefore, the actuator associated with the second directional control valve can be supplied with the hydraulic fluid at a sufficient flow rate. As a result, in spite of change in load conditions of the actuators, each actuator can be given appropriate driving forces or an appropriate flow rate of the hydraulic fluid with no need of priority instruction, and the working efficiency can be improved remarkably.

(2) In the above (1), preferably, the hydraulic control system further comprises input amount detecting means for detecting an input amount to operate the first directional control valve, and the control means controls, based on signals from the pressure detecting means and the input amount detecting means, the auxiliary flow control means to reduce a flow rate of the hydraulic fluid flowing through the input line when the pressure of the hydraulic fluid supplied from the hydraulic source is high and the input amount to operate the first directional control valve is large.

By so further providing the input amount detecting means and causing the control means to control the auxiliary flow control means to reduce a flow rate of the hydraulic fluid flowing through the input line when the pressure of the hydraulic fluid supplied from the hydraulic source is high and the input amount to operate the first directional control valve is large, even with the first directional control valve operated in a large stroke, each actuator can be given appropriate driving forces or an appropriate flow rate of the hydraulic fluid with no need of priority instruction in spite of change in load conditions of the actuators, as with the above (1). In addition, since the flow rate of the hydraulic fluid flowing through the input line can be adjusted depending on the input amount to operate the first directional control valve, the flow rate of the hydraulic fluid flowing through the input line is prevented from being reduced unnecessarily and the actuator associated with the second directional control valve can be supplied with the hydraulic fluid at a sufficient flow rate.

(3) In the above (1), preferably, the hydraulic control system further comprises first and second input amount detecting means for detecting input amounts to operate the first and second directional control valves, and the control means controls, based on signals from the pressure detecting means and the first and second input amount detecting means, the auxiliary flow control means to reduce a flow rate of the hydraulic fluid flowing through the input line when the pressure of the hydraulic fluid supplied from the hydraulic source is high, the input amount to operate the first directional control valve is large and the input amount to operate the second directional control valve is not small.

By so providing the first and second input amount detecting means and causing the control means to control the auxiliary flow control means to reduce a flow rate of the hydraulic fluid flowing through the input line when the pressure of the hydraulic fluid supplied from the hydraulic source is high, the input amount to operate the first directional control valve is large and the input amount to operate the second directional control valve is not small, in work where the second directional control valve is operated, each actuator can be given appropriate driving forces or an appropriate flow rate of the hydraulic fluid with no need of priority instruction in spite of change in load conditions of the actuators, and the flow rate of the hydraulic fluid flowing through the input line is prevented from being reduced unnecessarily, as with the above (2). In addition, since the flow rate of the hydraulic fluid flowing through the input line is reduced only when the second directional control valve is operated, it is possible to eliminate useless operation of the auxiliary flow control means and achieve stable control.

(4) In the above (1), preferably, the auxiliary flow control means is a variable throttle, and the control means includes processing means for calculating a target opening area of the variable throttle from the pressure of the hydraulic fluid detected by the pressure detecting means, and outputs a command signal corresponding to the calculated target opening area.

(5) In the above (2), preferably, the auxiliary flow control means is a variable throttle, and the control means includes processing means for calculating a target opening area of the variable throttle from the pressure of the hydraulic fluid detected by the pressure detecting means and a target opening area of the variable throttle from the input amount detected by the input amount detecting means, and for selecting the higher one of the two calculated target opening areas, and outputs a command signal corresponding to the selected target opening area.

(6) In the above (3), preferably, the auxiliary flow control means is a variable throttle, and the control means includes processing means for calculating a target opening area of the variable throttle from the pressure of the hydraulic fluid detected by the pressure detecting means and target opening areas of the variable throttle from the input amounts detected by the first and second input amount detecting means, and for selecting the maximum one of the three calculated target opening areas, and outputs a command signal corresponding to the selected target opening area.

(7) In the above (4), preferably, the processing means calculates the target opening area of the variable throttle such that the target opening area is large when the pressure of the hydraulic fluid is low, and the target opening area is small when the pressure of the hydraulic fluid is high.

(8) In the above (5), preferably, the processing means sets therein such a relationship between the pressure of the hydraulic fluid and the target opening area of the variable throttle that the target opening area is large when the pressure of the hydraulic fluid is low and the target opening area is small when the pressure of the hydraulic fluid is high, and such a relationship between the input amount detected by the input amount detecting means and the target opening area of the variable throttle that the target opening area is large when the input amount is small and the target opening area is small when the input amount is large, and calculates the target opening area of the variable throttle based on those relationships.

(9) In the above (6), preferably, the processing means sets therein such a relationship between the pressure of the hydraulic fluid and the target opening area of the variable throttle that the target opening area is large when the pressure of the hydraulic fluid is low and the target opening area is small when the pressure of the hydraulic fluid is high, and such a relationship between each of the input amounts detected by the first and second input amount detecting means and the target opening area of the variable throttle that the target opening area is large when the input amount is small and the target opening area is small when the input amount is large, and calculates the target opening area of the variable throttle based on those relationships.

(10) In any of the above (1) to (9), the plurality of actuators may include a swing motor and an arm cylinder of a hydraulic excavator, and the first and second directional control valves may be directional control valves for the swing motor and the arm cylinder, respectively.

DETAILED DESCRIPTION OF THE PREFERRED EMBODIMENTS

A first embodiment of the present invention will be described hereunder with reference to FIGS. 1 to 3. The construction of a hydraulic control system of this embodiment, shown in FIG. 1, will be first described.

Figure 1:
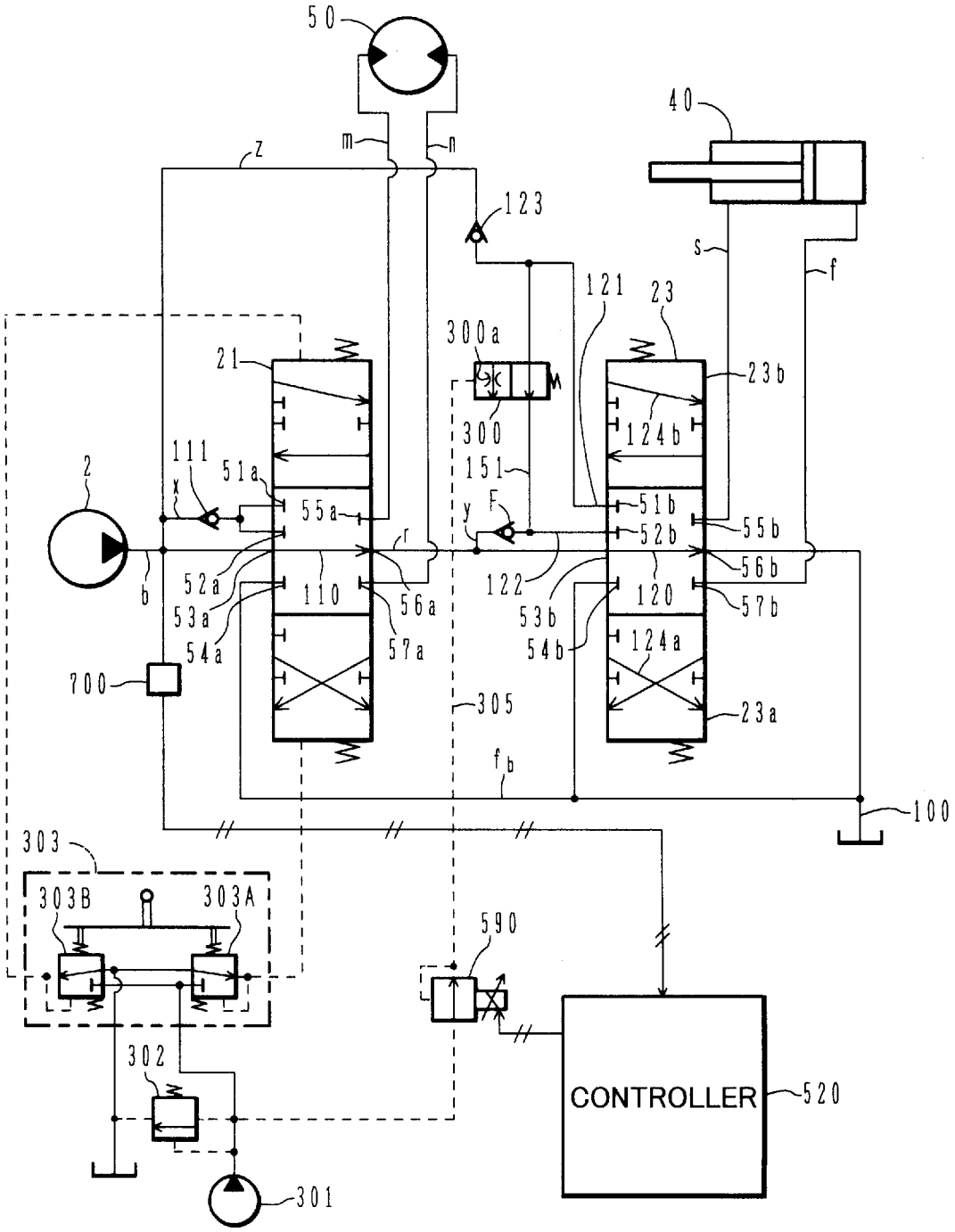
FIG. 1 is a hydraulic circuit diagram of a hydraulic working machine according to a first embodiment of the present invention.

In FIG. 1, the hydraulic control system of this embodiment comprises a first directional control valve 21 for introducing a hydraulic fluid supplied from a hydraulic source (hydraulic pump) 2 to a swing motor 50, and a second directional control valve 23 for introducing the hydraulic fluid to an arm cylinder 40. These directional control valves 21, 23 have center bypass passages 110, 120 for communicating center bypass lines b, r and a reservoir 100 with each other when the valves are in neutral positions, first input ports 51*a*, 51*b* and second input ports 52*a*, 52*b* for taking in the hydraulic fluid through check valves 111, 123, F disposed in lines x, y, z branched from the center bypass lines b, r, reservoir ports 54*a*, 54*b* for introducing the hydraulic fluid to the reservoir 100, and output ports 55*a*, 57*a*; 55*b*, 57*b* for introducing the hydraulic fluid to the swing motor 50 and the arm cylinder 40, respectively. Also, the first input port 51*b* of the directional control valve 23 is connected to the branch line z through an input line 121, and the second input port 52*b* thereof is connected to the branch line z through input lines 122, 151 and also to the branch line y through the input line 122. A control valve 300 having a variable throttle 300*a* is disposed as auxiliary flow control means in the input line 151.

The directional control valve 21 is supplied with a pilot pressure set through a pilot pump 301 and a relief valve 302 depending on an input amount by which a pilot valve 303 is operated, the pilot pressure causing the directional control valve 21 to shift its position. The pilot valve 303 includes pressure reducing valves 303A, 303B for adjusting the pilot pressure depending on an input amount by which a swing control lever is operated (i.e., a swing lever input amount).

The hydraulic control system further comprises a solenoid proportional valve (electric proportional pressure reducing valve) 590 for supplying a command pilot pressure to the control valve 300, a pump pressure sensor 700 for detecting a pressure of the hydraulic fluid delivered from the hydraulic source 2, and a controller 520 for receiving a detection signal from the pump pressure sensor 700, calculating a command pilot pressure for the control valve 300 based on the input signal, and outputting a command signal in accordance with the calculated result to the solenoid proportional valve 590.

Figure 2:
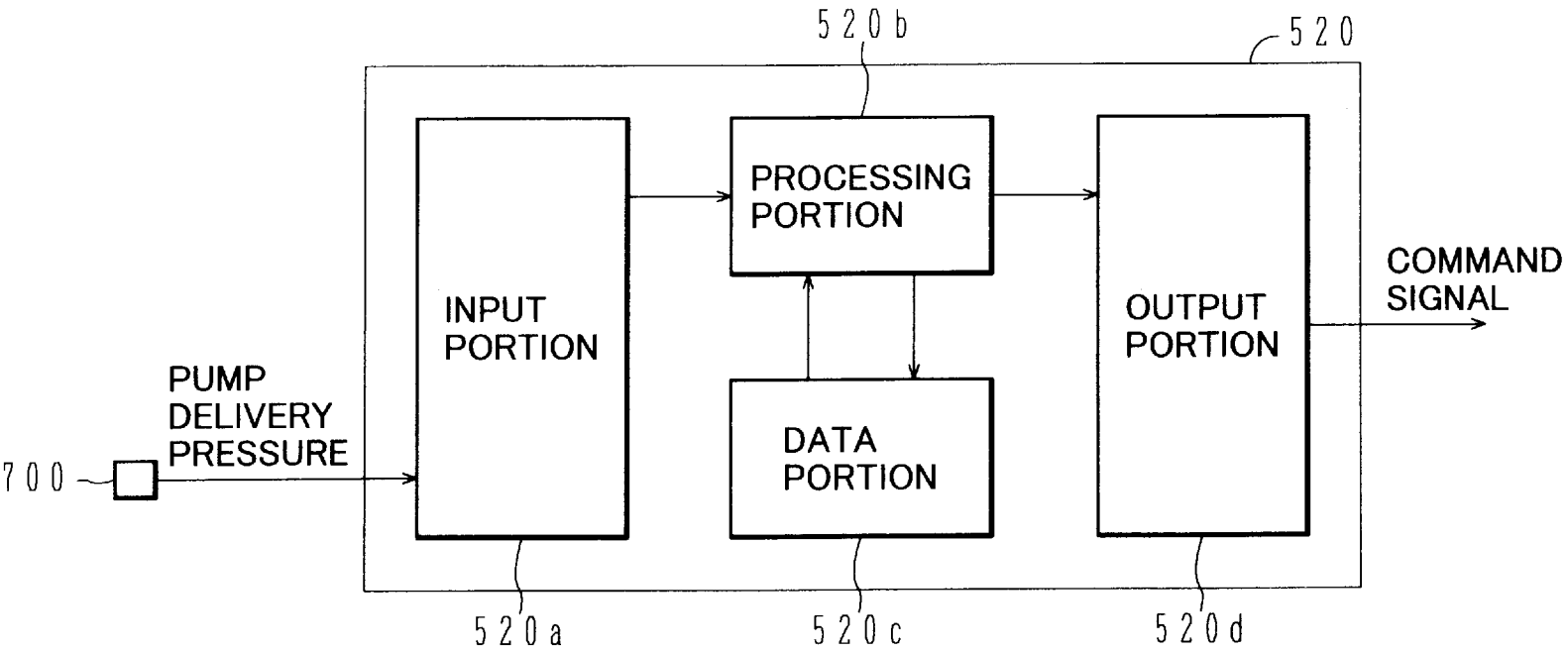
FIG. 2 is a block diagram showing the configuration of a controller.

The controller 520 comprises, as shown in FIG. 2, an input portion 520*a* for taking in the detection signal from the pump pressure sensor 700, a data portion 520*c* in which is set beforehand the relationship between the detection signal (pump delivery pressure) from the pump pressure sensor 700 and a target opening area of the variable throttle 300*a*, a processing portion 520*b* for receiving the detection signal from the input portion 520*a*, reading the data from the data portion 520*c* and calculating a command pilot pressure for the control valve 300, and an output portion 520*d* for receiving the calculated value from the processing portion 520*b*, converting it into a command signal for the solenoid proportional valve 590 and outputting the command signal.

Figure 3:
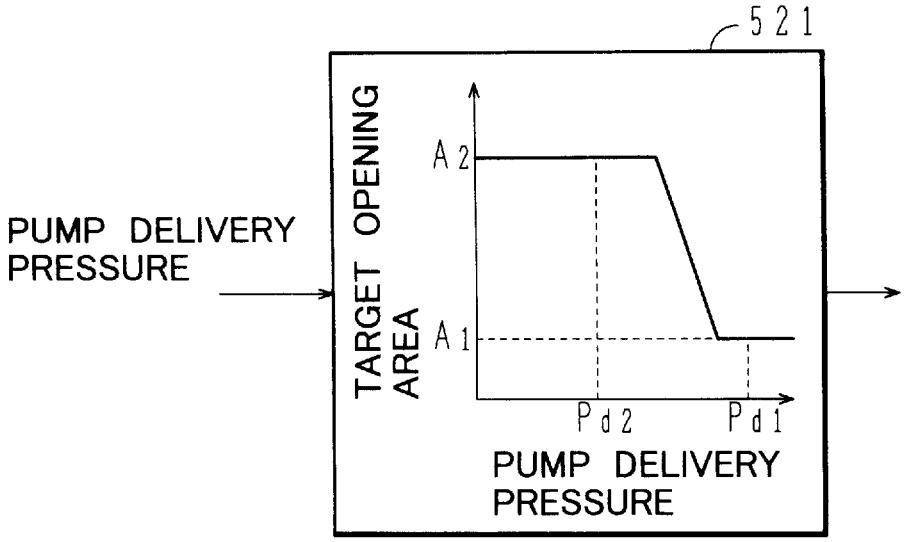
FIG. 3 is a functional block diagram showing a calculation process executed in a processing portion.

Specifically, the relationship between the pump delivery pressure and the target opening area of the variable throttle 300*a* is set in the data portion 520*c* such that the target opening area of the variable throttle 300*a* is large when the pump delivery pressure is low and less than a predetermined pressure, and is small when the pump delivery pressure is high, as shown in FIG. 3. The processing portion 520*b* calculates, in a block 521 shown in FIG. 3, a target opening area of the variable throttle 300*a* corresponding to the pump delivery pressure, which is represented by the detection signal from the pump pressure sensor 700, based on the relationship set in the data portion 520*c*, and then calculates a command pilot pressure for the control valve 300. A command signal corresponding to the result thus calculated is output to the solenoid proportional valve 590.

Upon receiving the command signal from the controller 520, the solenoid proportional valve 590 produces a command pilot pressure for the control valve 300 corresponding to the input signal and controls the opening area of the variable throttle 300*a* of the control valve 300.

The operation of this embodiment will be described below.

When the directional control valve 21 is operated to supply the hydraulic fluid to the swing motor 50 with intent to carry out digging work with the front device held in a pressed state under the swing operation (swing precedence work), an input port 53*a* of the center bypass passage 110 in the directional control valve 21 is blocked, whereupon the hydraulic fluid is introduced from the first input port 51*a* or the second input port 52*a* to the output port 55*a* or 57*a* through the check valve 111 and then supplied to the swing motor 50 through a line m or n. At this time, since the front device is held pressed against a groove side wall, the pump delivery pressure is raised. Therefore, the pump delivery pressure detected by the pump pressure sensor 700 and input to the controller 520 takes a high value Pd1. Based on this high Pd1, the processing portion 520*b* of the controller 520 calculates, in the block 521 shown in FIG. 3, a small value A1 as a target opening area of the variable throttle 300*a* corresponding to the pump delivery pressure. Accordingly, the opening area of the variable throttle 300*a* of the control valve 300 is controlled to become small.

In the above condition, when the directional control valve 23 is operated to move to a shift position 23*a* corresponding to the extending direction of the arm cylinder 40 with intent to carry out the arm crowding operation, the first input port 51*b* of the directional control valve 23 is blocked, whereupon the hydraulic fluid flowing into the branch line z is forwarded to the second input port 52*b* through the check valve 123 and the control valve 300 and then introduced to a line f through a passage 124*a* and the output port 57*b* for supply to a hydraulic chamber of the arm cylinder 40 on the bottom side. Also, the hydraulic fluid drained from a hydraulic chamber of the arm cylinder 40 on the rod side is returned to the reservoir 100 through a line s and the reservoir port 54*b* of the directional control valve 23. On this occasion, as stated above, the opening area of the variable throttle 300*a* of the control valve 300 is small and the pump delivery pressure is kept high. It is therefore possible to secure a high driving pressure of the swing motor 50 and provide driving forces required for the digging work under the swing pressing operation, i.e., the swing precedence work.

Meanwhile, when the same operation as described above is performed with intent to carry out smoothing work under the swing operation (arm precedence work), the pump delivery pressure is lower than that during the above digging work under the swing pressing operation because swing forces necessary for the smoothing work are small. Therefore, the pump delivery pressure detected by the pump pressure sensor 700 and input to the controller 520 takes a relatively low value Pd2. Based on this low value Pd2, the processing portion 520*b* of the controller 520 calculates a large value A2 as a target opening area of the variable throttle 300*a* corresponding to the pump delivery pressure. Accordingly, the opening area of the variable throttle 300*a* of the control valve 300 is controlled to become large.

In the above condition, when the directional control valve 23 is operated to move to the shift position 23*a* with intent to carry out the arm crowding operation, the first input port 51*b* of the directional control valve 23 is blocked, whereupon the hydraulic fluid flowing into the branch line z is forwarded to the second input port 52*b* through the check valve 123 and the control valve 300 and then introduced to the line f through the passage 124*a* and the output port 57*b* for supply to the hydraulic chamber of the arm cylinder 40 on the bottom side. Also, the hydraulic fluid drained from the hydraulic chamber of the arm cylinder 40 on the rod side is returned to the reservoir 100 through the line s and the reservoir port 54*b* of the directional control valve 23. On this occasion, since the opening area of the variable throttle 300*a* of the control valve 300 is large as stated above, the hydraulic fluid is surely supplied to the hydraulic chamber of the arm cylinder 40 on the bottom side at a flow rate required for the smoothing work under the swing operation, i.e., the arm precedence work, and the arm crowding speed is not slowed down.

As described above, according to this embodiment, when the digging work under the swing pressing operation, i.e., the swing precedence work, is performed, the variable throttle 300*a* is throttled to a large extent and a high driving pressure of the swing motor 50 is secured to provide satisfactory driving forces and hence swing pressing forces. During the smoothing work under the swing operation, i.e., the arm precedence work, an amount by which the variable throttle 300*a* is throttled is reduced to supply the hydraulic fluid to the arm cylinder 40 at a sufficient flow rate. As a result, the swing precedence operation or the arm precedence operation can be selectively performed in an automatic manner with no need of priority instruction and the working efficiency is remarkably increased.

A second embodiment of the present invention will be described with reference to FIGS. 4 to 6. In these figures, equivalent members and components to those in FIGS. 1 to 3 are denoted by the same reference numerals.

Figure 4:
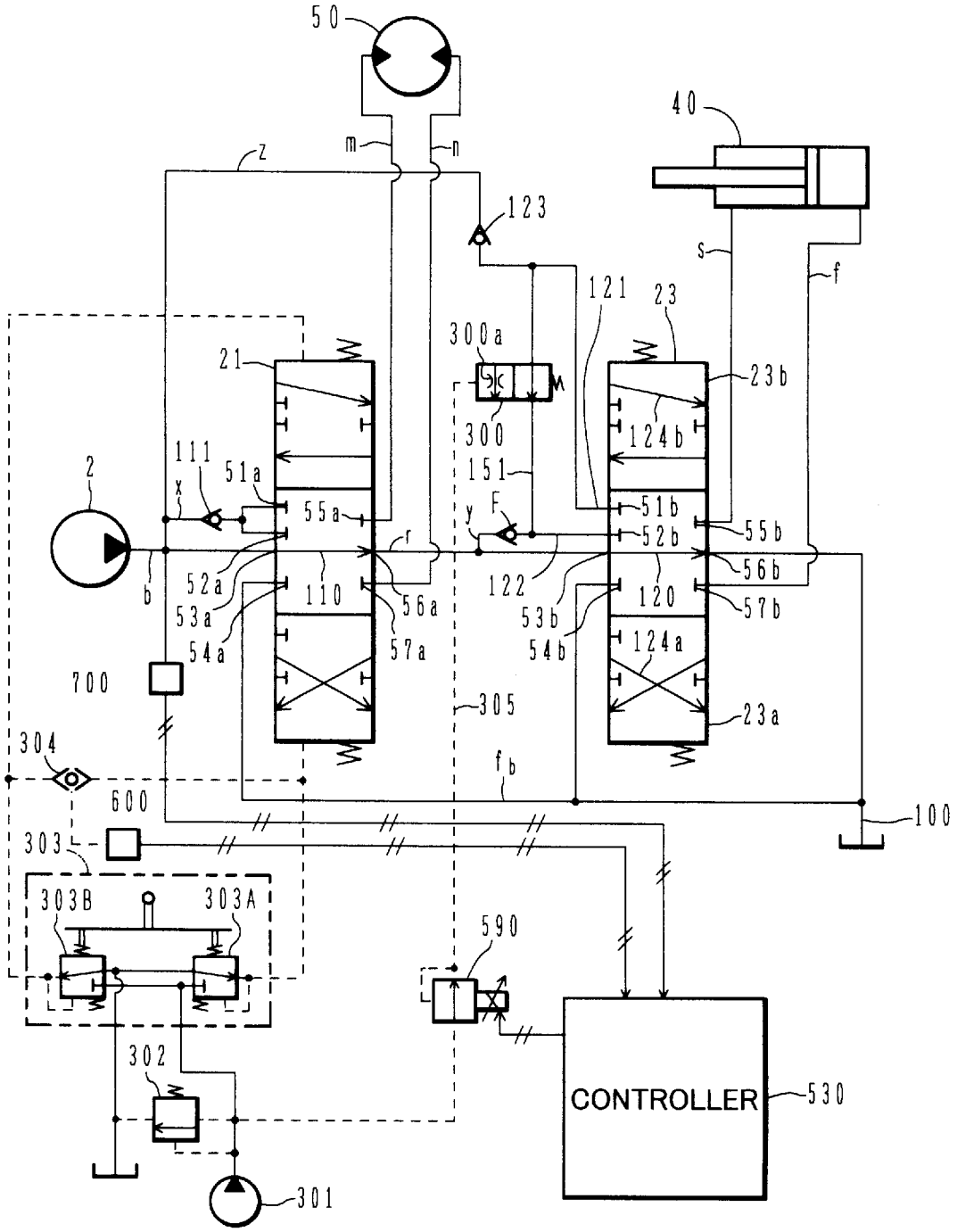
FIG. 4 is a hydraulic circuit diagram of a hydraulic working machine according to a second embodiment of the present invention.

In FIG. 4, a hydraulic control system of this second embodiment differs from that of the first embodiment in further comprising a shuttle valve 304 for selecting higher one of pilot pressures introduced from the pressure reducing valves 303A and 303B of the pilot valve 303, and a swing pilot pressure sensor 600 for detecting a higher pilot pressure introduced from the shuttle valve 304, a detection signal from the swing pilot pressure sensor 600 being also sent to a controller 530.

Figure 5:
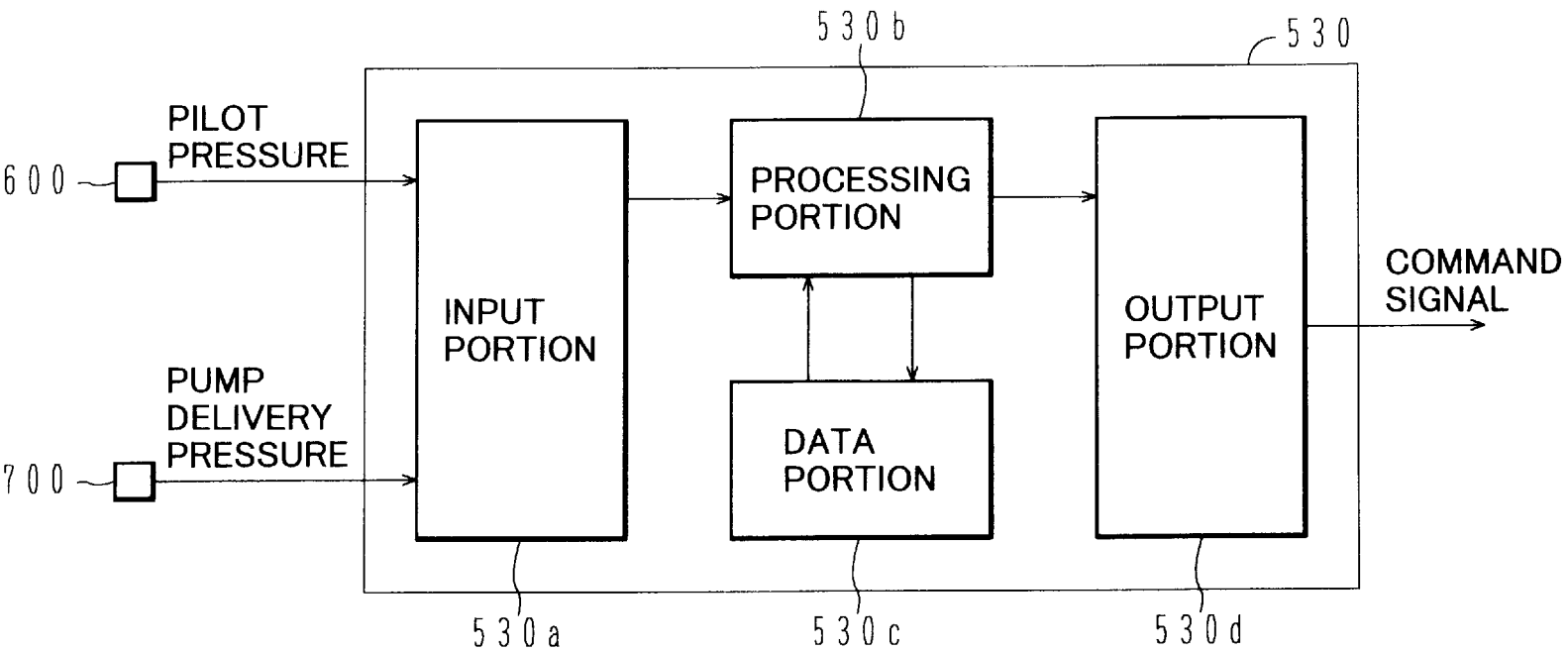
FIG. 5 is a block diagram showing the configuration of a controller.

The controller 530 comprises, as shown in FIG. 5, an input portion 530*a* for taking in the detection signal from the pump pressure sensor 700 and the detection signal from the swing pilot pressure sensor 600, a data portion 530*c* in which are set beforehand the relationship between the detection signal (pump delivery pressure) from the pump pressure sensor 700 and a target opening area of the variable throttle 300*a* and the relationship between the detection signal (swing lever input amount) from the swing pilot pressure sensor 600 and a target opening area of the variable throttle 300*a*, a processing portion 530*b* for receiving the detection signals from the input portion 530*a*, reading the data from the data portion 530*c* and calculating a command pilot pressure for the control valve 300, and an output portion 530*d* for receiving the calculated value from the processing portion 530*b*, converting it into a command signal for the solenoid proportional valve 590 and outputting the command signal.

Figure 6:
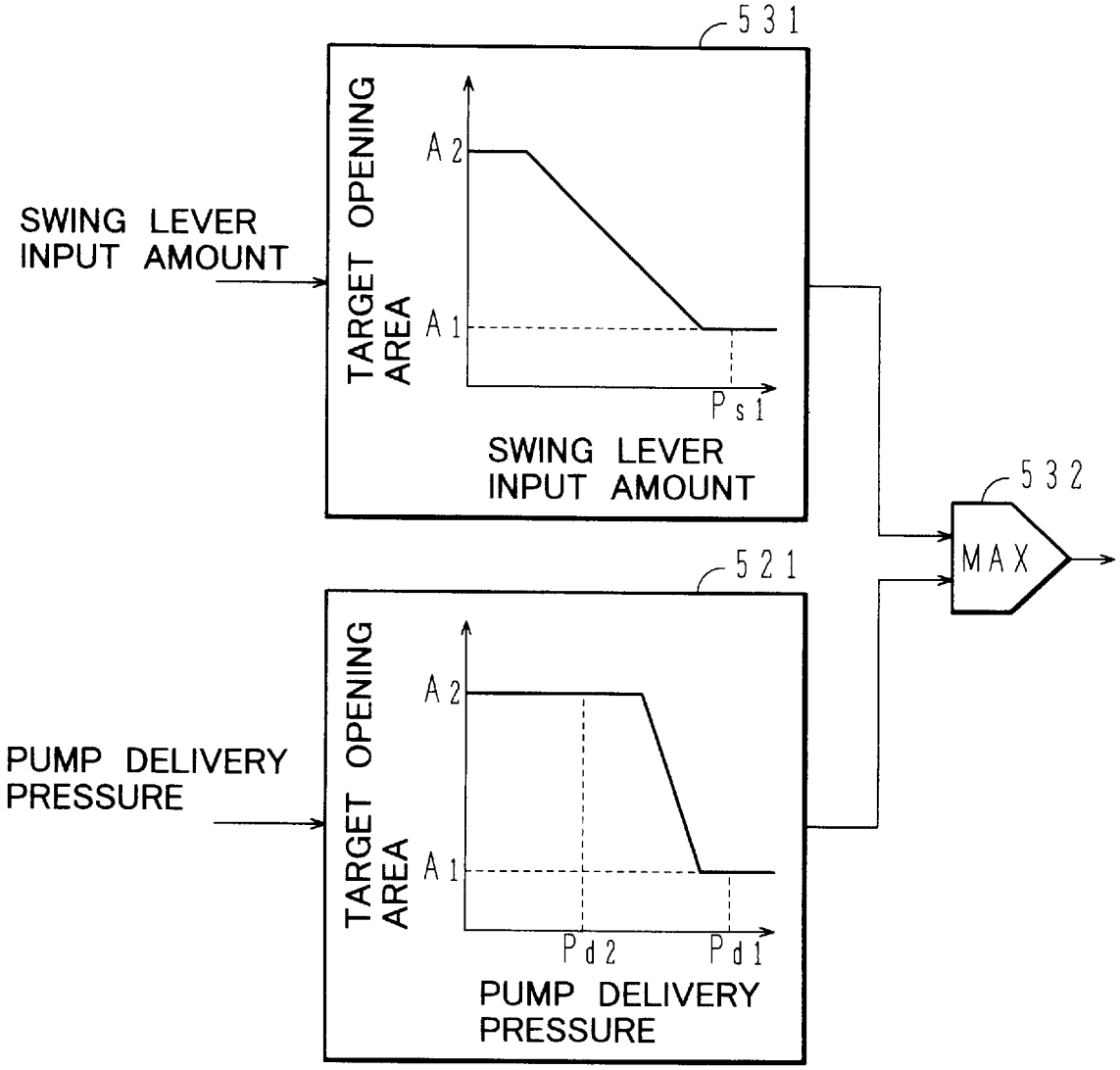
FIG. 6 is a functional block diagram showing a calculation process executed in a processing portion.

The data portion 530*c* sets therein, as shown in the block 521 of FIG. 6, the relationship between the pump delivery pressure and the target opening area of the variable throttle 300*a* that is the same as set in the data portion 520*c* of the first embodiment. The data portion 530*c* also sets therein the relationship between the swing lever input amount and the target opening area of the variable throttle 300*a* such that the target opening area of the variable throttle 300*a* is large when the swing lever input amount is small, reduces as the swing lever input amount increases, and is small when the swing lever input amount is large, as shown in a block 531 of FIG. 6. In the processing portion 530*b*, respective target opening areas of the variable throttle 300*a* corresponding to the swing lever input amount and the pump delivery pressure are calculated in the blocks 521, 531 based on the relationships set as described above, and larger one of the calculated target opening areas is selected by a maximum value selector 532. Then, a command pilot pressure for the control valve 300 is calculated corresponding to the selected target opening area and a command signal corresponding to the calculated result is output to the solenoid proportional valve 590.

The operation of this embodiment will be described below.

When the directional control valve 21 is operated to supply the hydraulic fluid to the swing motor 50 with intent to carry out digging work with the front device held in a pressed state under the swing operation (swing precedence work), the pump delivery pressure input to the controller 530 takes a high value Pd1 and, in the block 521 of the processing portion 530*b*, a small value A1 is calculated as a target opening area of the variable throttle 300*a*, as with the first embodiment described above. At this time, when the swing control lever is operated in a large stroke to provide strong swing pressing forces, the swing lever input amount takes a large value Ps1 and, in the block 531 of the processing portion 530*b*, a small value A1 is calculated as a target opening area of the variable throttle 300*a* corresponding to the swing lever input amount. Accordingly, the maximum value selector 532 selects the value A1 as the target opening area, whereby the opening area of the variable throttle 300*a* of the control valve 300 is controlled to become small.

In the above condition, when the directional control valve 23 is operated to move to the shift position 23*a* with intent to carry out the arm crowding operation, the pump delivery pressure is kept high because of the opening area of the variable throttle 300*a* taking the small value A1, as with the first embodiment described above. It is therefore possible to secure a high driving pressure of the swing motor 50 and provide driving forces required for the digging work under the swing pressing operation, i.e., the swing precedence work.

Further, if the swing lever input amount is reduced when strong swing pressing forces are not required during the digging work under the swing pressing operation, the target opening area calculated in the block 531 is gradually increased from A1 to A2 as the swing lever input amount reduces, and the opening area of the variable throttle 300*a* of the control valve 300 is controlled to become larger correspondingly. Therefore, the pump delivery pressure is lowered and the swing pressing forces are reduced. Thus, the swing pressing forces are adjusted in accordance with the swing lever input amount and the digging work under the swing pressing operation can be performed as intended by the operator.

Meanwhile, when the same operation as described above is performed with intent to carry out smoothing work under the swing operation (arm precedence work), the pump delivery pressure input to the controller 530 takes a relatively low value Pd2 because swing forces necessary for the smoothing work are small. Based on this low value Pd2, the processing portion 530*b* calculates a large value A2 as a target opening area of the variable throttle 300*a* corresponding to the pump delivery pressure. On the other hand, since the swing lever input amount takes a large value Ps1, for example, the processing portion 530*b* calculates, in the block 531, a small value A1 as a target opening area of the variable throttle 300*a* corresponding to the swing lever input amount. Accordingly, the maximum value selector 532 selects the value A2 as the target opening area, whereby the opening area of the variable throttle 300*a* of the control valve 300 is controlled to become large.

In the above condition, when the directional control valve 23 is operated to move to the shift position 23*a* with intent to carry out the arm crowding operation, it is resulted from the large opening area of the variable throttle 300*a* of the control valve 300, as with the first embodiment described above, that the hydraulic fluid is surely supplied to the hydraulic chamber of the arm cylinder 40 on the bottom side at a flow rate required for the smoothing work under the swing operation, i.e., the arm precedence work, and the arm crowding speed is not slowed down.

Further, during the sole arm crowding operation or during the combined operation of arm crowding and other working device operation than swing, since the swing lever input amount is nil (0), the processing portion 530*b* of the controller 530 calculates, in the block 531, a large value A2 as a target opening area of the variable throttle 300*a* corresponding to the swing lever input amount. Accordingly, the maximum value selector 532 selects the value A2 as the target opening area, whereby the opening area of the variable throttle 300*a* of the control valve 300 is controlled to become large. Thus, during the sole arm crowding operation or during the combined operation of arm crowding and other working device operation than swing, the variable throttle 300*a* is prevented from being throttled unnecessarily and the maneuverability is not deteriorated.

As seen from the above description, this embodiment can also provide similar advantages as obtainable with the first embodiment.

In addition, according to this embodiment, the target opening area of the variable throttle 300*a* corresponding to the swing lever input amount is calculated besides the target opening area thereof corresponding to the pump delivery pressure, and larger one of the target opening area corresponding to the swing lever input amount and the target opening area corresponding to the pump delivery pressure is selected to control the opening area of the variable throttle 300*a* of the control valve 300. During the combined operation of swing and arm crowding, e.g., during the digging work under the swing pressing operation, therefore, swing forces can be adjusted in accordance with the swing lever input amount and the combined operation can be performed satisfactorily. During normal digging work without accompanying the swing operation, since the opening area of the variable throttle 300*a* of the control valve 300 is not throttled, the hydraulic fluid is supplied to the arm cylinder 400 at a sufficient flow rate, the arm crowing speed is not slowed down, and hence satisfactory maneuverability is achieved.

A third embodiment of the present invention will be described with reference to FIGS. 7 to 9. In these figures, equivalent members and components to those in FIGS. 1 to 3 are denoted by the same reference numerals.

Figure 7:
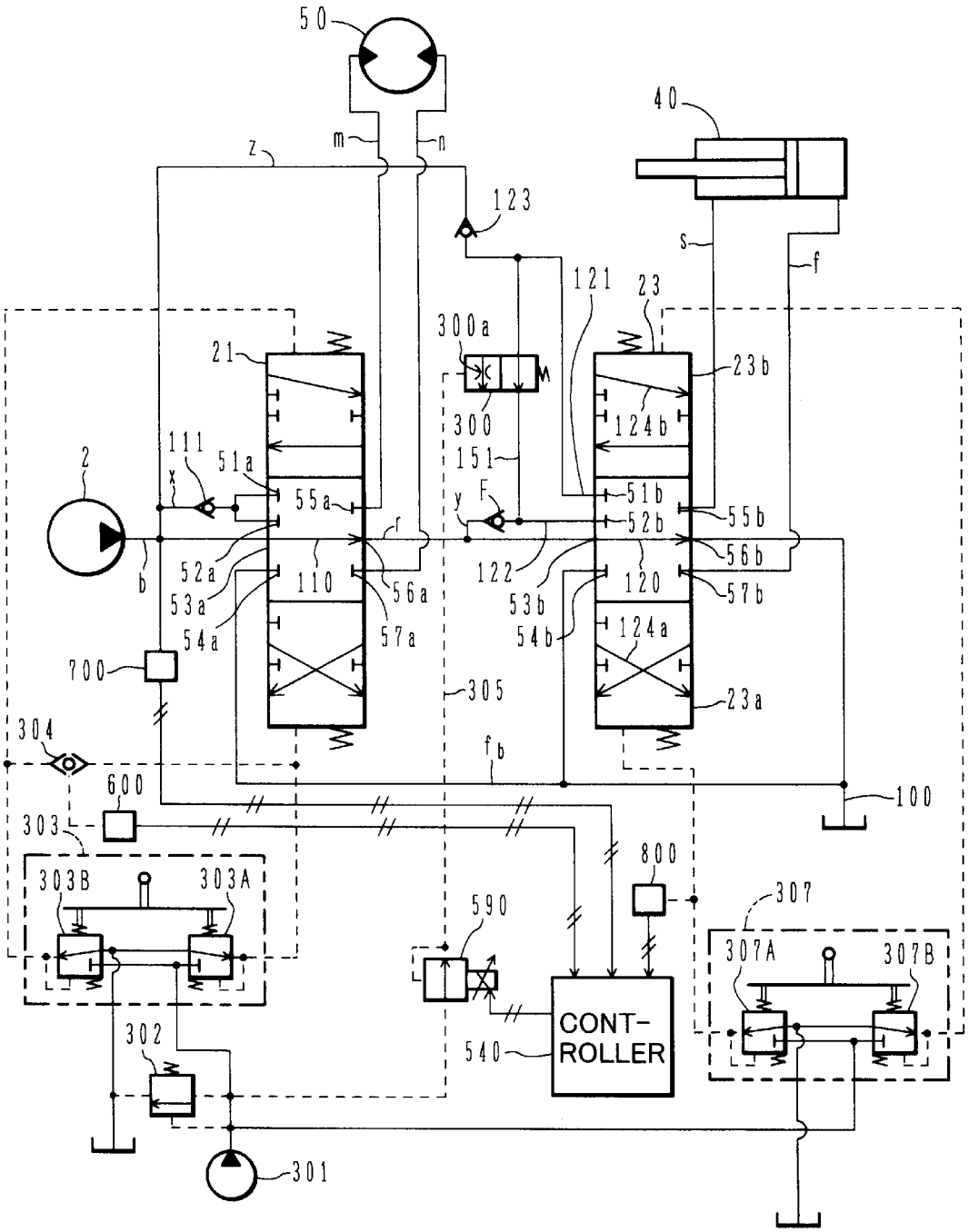
FIG. 7 is a hydraulic circuit diagram of a hydraulic working machine according to a third embodiment of the present invention.

In FIG. 7, denoted by 307 is a pilot valve for producing a pilot pressure to shift the directional control valve 23. The pilot valve 307 includes pressure reducing valves 307A and 307B for adjusting the pilot pressure depending on an input amount by which an arm control lever is operated (i.e., a swing lever input amount).

A hydraulic control system of this third embodiment differs from that of the second embodiment in further comprising an arm-crowding pilot pressure sensor 800 for detecting a pilot pressure on the side of the pressure reducing valve 307A of the pilot valve 307, i.e., on the arm-crowding side, a detection signal from the arm-crowding pilot pressure sensor 800 being also sent to a controller 540.

Figure 8:
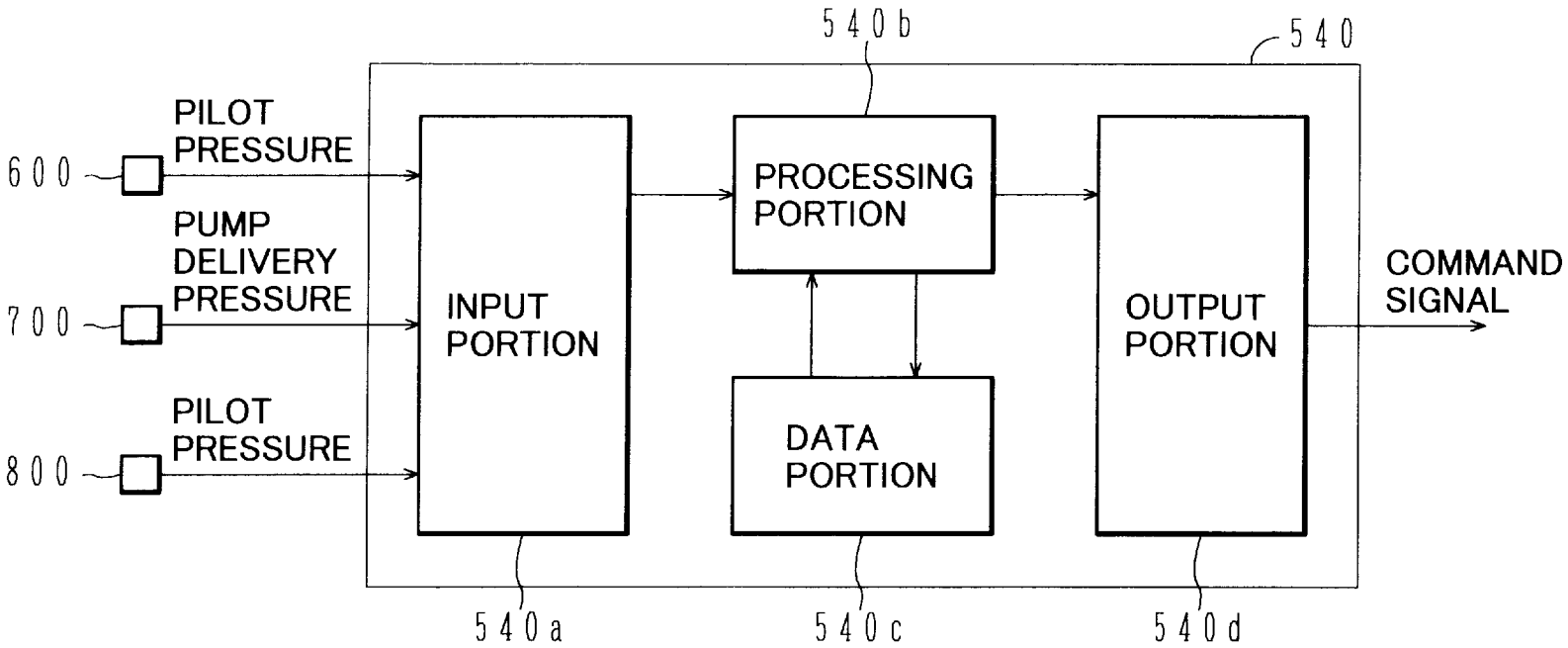
FIG. 8 is a block diagram showing the configuration of a controller.

The controller 540 comprises, as shown in FIG. 8, an input portion 540*a* for taking in the detection signals from the pump pressure sensor 700, the swing pilot pressure sensor 600 and the arm-crowding pilot pressure sensor 800, a data portion 540*c* in which are set beforehand the relationship between the detection signal (pump delivery pressure) from the pump pressure sensor 700 and a target opening area of the variable throttle 300*a*, the relationship between the detection signal (swing lever input amount) from the swing pilot pressure sensor 600 and a target opening area of the variable throttle 300*a*, and the relationship between the detection signal (arm- crowding input amount) from the arm-crowding pilot pressure sensor 800 and a target opening area of the variable throttle 300*a*, a processing portion 540*b* for receiving the detection signals from the input portion 540*a*, reading the data from the data portion 540*c* and calculating a command pilot pressure for the control valve 300, and an output portion 540*d* for receiving the calculated value from the processing portion 540*b*, converting it into a command signal for the solenoid proportional valve 590 and outputting the command signal.

Figure 9:
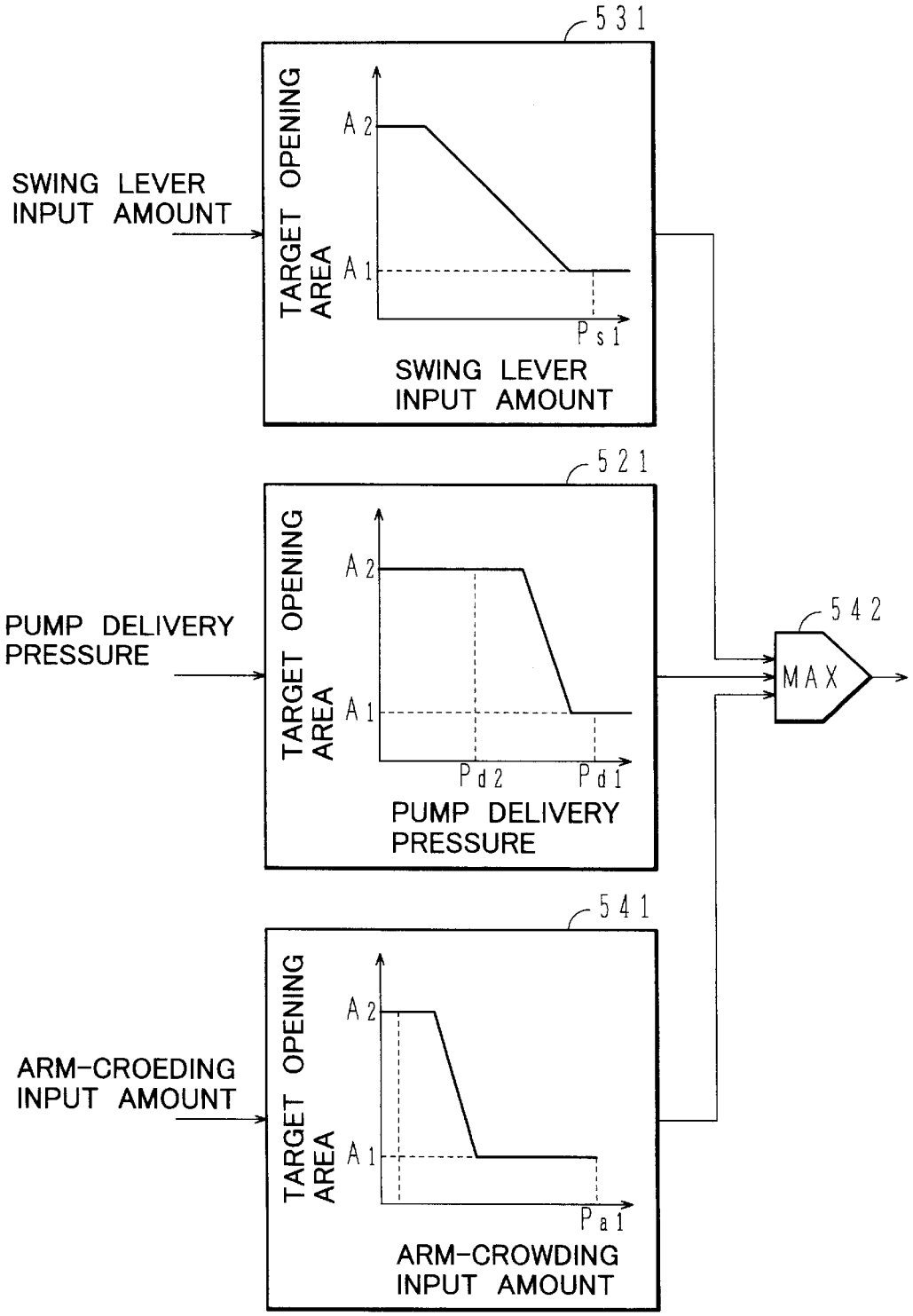
FIG. 9 is a functional block diagram showing a calculation process executed in a processing portion.

The data portion 540*c* sets therein, as shown in the blocks 521, 531 of FIG. 9, the relationship between the pump delivery pressure and the target opening area of the variable throttle 300*a* and the relationship between the swing lever input amount and the target opening area of the variable throttle 300*a*, these relationships being the same as set in the data portion 530*c* of the second embodiment. The data portion 540*c* also sets therein the relationship between the arm-crowding input amount and the target opening area of the variable throttle 300*a* such that the target opening area of the variable throttle 300*a* is large when the arm-crowding input amount is small, and is small when the arm-crowding input amount is large and not less than a predetermined value, as shown in a block 541 of FIG. 9.

In the processing portion 540*b*, respective target opening areas of the variable throttle 300*a* corresponding to the swing lever input amount, the pump delivery pressure and the arm-crowding input amount are calculated in the blocks 521, 531, 541 based on the relationships set as described above, and the maximum one of the calculated target opening areas is selected by a maximum value selector 542. Then, a command pilot pressure for the control valve 300 is calculated corresponding to the selected target opening area and a command signal corresponding to the calculated result is output to the solenoid proportional valve 590.

The operation of this embodiment will be described below.

When the directional control valve 21 is operated to supply the hydraulic fluid to the swing motor 50 with intent to carry out digging work with the front device held in a pressed state under the swing operation (swing precedence work), the pump delivery pressure input to the controller 540 takes a high value Pd1 and, in the block 521 of the processing portion 540*b*, a small value A1 is calculated as a target opening area of the variable throttle 300*a*, as with the second embodiment described above. Likewise, when the swing control lever is operated in a large stroke, the swing lever input amount takes a large value Ps1 and, in the block 531 of the processing portion 540*b*, a small value A1 is calculated as a target opening area of the variable throttle 300*a* corresponding to the swing lever input amount. Further, at this time, since the arm crowding operation is not yet started, a large value A2 is calculated as a target opening area of the variable throttle 300*a* corresponding to the arm-crowding lever input amount. Accordingly, the maximum value selector 542 selects the value A2 as the target opening area, whereby the opening area of the variable throttle 300*a* of the control valve 300 is controlled to become large.

In the above condition, when the directional control valve 23 is operated to move to the shift position 23*a* with intent to carry out the arm crowding operation, the arm-crowding input amount takes a value Pa1, for example, and a small value A1 is calculated in the block 541 of the processing portion 540*b* as a target opening area of the variable throttle 300*a* . Thus, the target opening areas calculated in the blocks 521, 531, 541 all take the small values A1. Accordingly, the maximum value selector 542 selects the value A1 as the target opening area, whereby the opening area of the variable throttle 300*a* of the control valve 300 is controlled to become small. It is therefore possible to secure a high driving pressure of the swing motor 50 and provide driving forces required for the digging work under the swing pressing operation, i.e., the swing precedence work.

Further, if the swing lever input amount is reduced when strong swing pressing forces are not required during the digging work under the swing pressing operation, the opening area of the variable throttle 300*a* of the control valve 300 is controlled to become larger correspondingly, as with the second embodiment described above. Therefore, the pump delivery pressure is lowered and the swing pressing forces are reduced.

Meanwhile, when the same operation as described above is performed with intent to carry out smoothing work under the swing operation (arm precedence work), the processing portion 540*b* calculates, in the block 521, a large target opening area A2 corresponding to a relatively low pump delivery pressure Pd2 because swing forces necessary for the smoothing work are small, and also calculates, in the block 531, a small target opening area A1 of the variable throttle 300*a* corresponding to a large swing lever input amount Ps1. Further, at this time, since the arm crowding operation is not yet started, the large value A2 is calculated as a target opening area of the variable throttle 300*a* corresponding to the arm-crowding lever input amount. Accordingly, the maximum value selector 542 selects the value A2 as the target opening area, whereby the opening area of the variable throttle 300*a* of the control valve 300 is controlled to become large.

In the above condition, when the directional control valve 23 is operated to move to the shift position 23*a* with intent to carry out the arm crowding operation, the processing portion 540*b* calculates, in the block 541, a small value A1 as a target opening area of the variable throttle 300*a* corresponding to the arm-crowding input amount because the arm-crowding input amount takes a value Pa1, for example. However, since the block 521 continues to calculate the large value A2, the maximum value selector 542 still selects the value A2 as the target opening area, whereby the opening area of the variable throttle 300*a* of the control valve 300 is kept large. As a result, the hydraulic fluid is surely supplied to the hydraulic chamber of the arm cylinder 40 on the bottom side at a flow rate required for the smoothing work under the swing operation, i.e., the arm precedence work, and the arm crowding speed is not slowed down.

Further, during the sole arm crowding operation or during the combined operation of arm crowding and other working device operation than swing, since the swing lever input amount is nil (0), the opening area of the variable throttle 300*a* of the control valve 300 is controlled to become large as with the second embodiment described above. Consequently, the variable throttle 300*a* is prevented from being throttled unnecessarily and the maneuverability is not deteriorated.

As seen from the above description, this embodiment can also provide similar advantages as obtainable with the second embodiment.

In addition, according to this embodiment, since the opening area of the variable throttle 300*a* of the control valve 300 is throttled only after the arm crowding operation is started, it is possible to eliminate useless operation of the control valve 30 and achieve stable control.

It should be noted that while the above embodiments have been described in the case where the present invention is applied to a hydraulic control system including a swing motor and an arm cylinder, the present invention is also similarly adapted and similar advantages as described above can be achieved for any hydraulic control system including a plurality of actuators wherein load conditions of the actuators are varied and the order of priority in supply of the hydraulic fluid to the actuators is changed correspondingly.

In short, according to the present invention, in spite of change in load conditions of actuators, each actuator can be given appropriate driving forces or an appropriate flow rate of a hydraulic fluid with no need of priority instruction, resulting in remarkable improvement of working efficiency.

What is claimed is:

1. A hydraulic control system for a hydraulic working machine, comprising:

a hydraulic source;

a plurality of actuators driven by a hydraulic fluid supplied from said hydraulic source;

a plurality of directional control valves controlling respective flows of the hydraulic fluid supplied to said plurality of actuators, said plurality of directional control valves including first and second directional control valves connected to said hydraulic source in parallel;

auxiliary flow control means disposed in an input line connected to an input port of said second directional control valve;

pressure detecting means for detecting a pressure of the hydraulic fluid supplied from said hydraulic source; and control means for controlling, based on a signal from said pressure detecting means, said auxiliary flow control means to reduce a flow rate of the hydraulic fluid flowing only through said input line when the pressure of the hydraulic fluid supplied from said hydraulic source is high;

wherein said directional control valves are of the center bypass type.

2. A hydraulic control system for a hydraulic working machine comprising:

a hydraulic source;

a plurality of actuators driven by a hydraulic fluid supplied from said hydraulic source;

a plurality of directional control valves controlling respective flows of the hydraulic fluid supplied to said plurality of actuators, said plurality of directional control valves including first and second directional control valves connected to said hydraulic source in parallel;

auxiliary flow control means disposed in an input line connected to an input port of said second directional control valve;

pressure detecting means for detecting a pressure of the hydraulic fluid supplied from said hydraulic source;

control means for controlling, based on a signal from said pressure detecting means, said auxiliary flow control means to reduce a flow rate of the hydraulic fluid flowing only through said input line when the pressure of the hydraulic fluid supplied from said hydraulic source is high; and input amount detecting means for detecting an input amount to operate said first directional control valve;

wherein said control means controls, based on signals from said pressure detecting means and said input amount detecting means, said auxiliary flow control means to reduce a flow rate of the hydraulic fluid flowing through said input line when the pressure of the hydraulic fluid supplied from said hydraulic source is high and the input amount to operate said first directional control valve is large.

3. A hydraulic control system for a hydraulic working machine according to claim 2, wherein said auxiliary flow control means is a variable throttle, and said control means includes processing means for calculating a target opening area of said variable throttle from the pressure of the hydraulic fluid detected by said pressure detecting means and a target opening area of said variable throttle from the input amount detected by said input amount detecting means, and for selecting a higher one of said two calculated target opening areas, and outputs a command signal corresponding to the selected target opening area.

4. A hydraulic control system for a hydraulic working machine according to claim 3, wherein said processing means sets therein such a relationship between the pressure of said hydraulic fluid and the target opening area of said variable throttle that the target opening area is large when the pressure of said hydraulic fluid is low and the target opening area is small when the pressure of said hydraulic fluid is high, and such a relationship between the input amount detected by said input amount detecting means and the target opening area of said variable throttle that the target opening area is large when the input amount is small and the target opening area is small when the input amount is large, and calculates the target opening area of said variable throttle based on said relationships.

5. A hydraulic control system for a hydraulic working machine, comprising:

a hydraulic source;

a plurality of actuators driven by a hydraulic fluid supplied from said hydraulic source;

a plurality of directional control valves controlling respective flows of the hydraulic fluid supplied to said plurality of actuators, said plurality of directional control valves including first and second directional control valves connected to said hydraulic source in parallel;

auxiliary flow control means disposed in an input line connected to an input port of said second directional control valve;

pressure detecting means for detecting a pressure of the hydraulic fluid supplied from said hydraulic source;

control means for controlling, based on a signal from said pressure detecting means, said auxiliary flow control means to reduce a flow rate of the hydraulic fluid flowing only through said input line when the pressure of the hydraulic fluid supplied from said hydraulic source is high; and first and second input amount detecting means for detecting input amounts to operate said first and second directional control valves;

wherein said control means controls, based on signals from said pressure detecting means and said first and second input amount detecting means, said auxiliary flow control means to reduce a flow rate of the hydraulic fluid flowing through said input line when the pressure of the hydraulic fluid supplied from said hydraulic source is high, the input amount to operate said first directional control valve is large and the input amount to operate said second directional control valve is not small.

6. A hydraulic control system for a hydraulic working machine according to claim 5, wherein said auxiliary flow control means is a variable throttle, and said control means includes processing means for calculating a target opening area of said variable throttle from the pressure of the hydraulic fluid detected by said pressure detecting means and target opening areas of said variable throttle from the input amounts detected by said first and second input amount detecting means, and for selecting a maximum one of said three calculated target opening areas, and outputs a command signal corresponding to the selected target opening area.

7. A hydraulic control system for a hydraulic working machine according to claim 6, wherein said processing means sets therein such a relationship between the pressure of said hydraulic fluid and the target opening area of said variable throttle that the target opening area is large when the pressure of said hydraulic fluid is low and the target opening area is small when the pressure of said hydraulic fluid is high, and such a relationship between each of the input amounts detected by said first and second input amount detecting means and the target opening area of said variable throttle that the target opening area is large when the input amount is small and the target opening area is small when the input amount is large, and calculates the target opening area of said variable throttle based on said relationships.

8. A hydraulic control system for a hydraulic working machine, comprising:

a hydraulic source;

a plurality of actuators driven by a hydraulic fluid supplied from said hydraulic source;

a plurality of directional control valves controlling respective flows of the hydraulic fluid supplied to said plurality of actuators, said plurality of directional control valves including first and second directional control valves connected to said hydraulic source in parallel;

auxiliary flow control means disposed in an input line connected to an input port of said second directional control valve;

pressure detecting means for detecting a pressure of the hydraulic fluid supplied from said hydraulic source; and control means for controlling, based on a signal from said pressure detecting means, said auxiliary flow control means to reduce a flow rate of the hydraulic fluid flowing only through said input line when the pressure of the hydraulic fluid supplied from said hydraulic source is high;

wherein said auxiliary flow control means is a variable throttle, and said control means includes processing means for calculating a target opening area of said variable throttle from the pressure of the hydraulic fluid detected by said pressure detecting means, and outputs a command signal corresponding to the calculated target opening area.

9. A hydraulic control system for a hydraulic working machine according to claim 8, wherein said processing means calculates the target opening area of said variable throttle such that the target opening area is large when the pressure of said hydraulic fluid is low, and the target opening area is small when the pressure of said hydraulic fluid is high.

10. A hydraulic control system for a hydraulic working machine, comprising:

a hydraulic source;

a plurality of actuators driven by a hydraulic fluid supplied from said hydraulic source;

a plurality of directional control valves controlling respective flows of the hydraulic fluid supplied to said plurality of actuators, said plurality of directional control valves including first and second directional control valves connected to said hydraulic source in parallel;

auxiliary flow control means disposed in an input line connected to an input port of said second directional control valve;

pressure detecting means for detecting a pressure of the hydraulic fluid supplied from said hydraulic source; and control means for controlling, based on a signal from said pressure detecting means, said auxiliary flow control means to reduce a flow rate of the hydraulic fluid flowing only through said input line when the pressure of the hydraulic fluid supplied from said hydraulic source is high;

wherein said plurality of actuators include a swing motor and an arm cylinder of a hydraulic excavator, and said first and second directional control valves are directional control valves for said swing motor and said arm cylinder, respectively.

* * * * *